United States Patent [19]

Shanks et al.

[11] 3,962,050

[45] June 8, 1976

[54] RECOVERY OF ZINC FROM ZINC CHLORIDE BY FUSED SALT ELECTROLYSIS

[75] Inventors: Donald E. Shanks; Frank P. Haver, both of Reno, Nev.

[73] Assignee: The United States of America as represented by the Secretary of the Interior, Washington, D.C.

[22] Filed: May 21, 1975

[21] Appl. No.: 579,640

[52] U.S. Cl. ..... 204/66

[51] Int. Cl.[2] ..... C25C 3/34

[58] Field of Search ..... 204/66

[56] References Cited

UNITED STATES PATENTS 1,299,947 4/1919 Ingeberg ..... 204/66

3,852,173 12/1974 Jacobs et al. ..... 204/67

*Primary Examiner*—John H. Mack

*Assistant Examiner*—Aaron Weisstuch

*Attorney, Agent, or Firm*—William S. Brown; Donald R. Fraser

[57] ABSTRACT

Metallic zinc is recovered from zinc chloride by electrolysis of a molten bath mixture consisting essentially of zinc chloride and an electrolyte consisting of lithium chloride and potassium chloride. The electrolyte preferably consists of the LiCl-KCl eutectric mixture consisting of 59 mole percent LiCl and 41 mole percent KCl.

7 Claims, No Drawings

RECOVERY OF ZINC FROM ZINC CHLORIDE BY FUSED SALT ELECTROLYSIS

Zinc metal is normally prepared commercially by one of five methods: (1) Horizontal retort process; (2) Vertical retort process; (3) Electrothermic process; (4) Imperial Smelting process; and (5) Electrolytic process. The first four processes all involve roasting, sintering, charge preparation, condensation of zinc vapor, casting of metal, and, if high grade zinc is needed, further purification steps. All of these methods suffer from labor problems, a tightening of impurity specifications, and pollution control regulations.

The impurity specifications and pollution control regulations are met to a great extent by the electrolytic process, but labor is still a major problem. The electrolytic process is the preferred method of producing zinc at the present time and involves the roasting of zinc concentrate followed by dissolution in aqueous sulfuric acid, purification of the leach solution, electrolysis of the leach solution, stripping of cathodes, and melting and casting of the zinc metal. Costs of the aqueous electrolytic process are relatively high because $SO_2$ fixation is essential, zinc recoveries are relatively low, an extremely pure solution is needed for electrolysis, and considerable labor is involved in stripping the cathodes.

A very limited amount of fused-salt experimentation has been reported on the electrowinning of zinc metal. Mellor, in "A Comprehensive Treatise on Inorganic and Theoretical Chemistry", V. 4, 1940, pp. 417–418, discusses early efforts to electrowin zinc from zinc chloride and, although some metal was produced, there was no real effort to find an ideal salt combination for the molten bath. As a result, many problems were encountered and current efficiencies were poor.

It has now been found, according to the process of the invention, that the above disadvantages of the prior art processes may be largely overcome by electrolysis of a molten bath consisting essentially of zinc chloride and a lithium chloride - potassium chloride electrolyte having a composition of about 50 to 70 mole percent of lithium chloride and about 50 to 30 mole percent of potassium chloride. Preferably, the electrolyte consists of the LiCl-KCl eutectic containing 59 mole percent LiCl and 41 mole percent KCl. By means of this process, zinc metal is deposited, in molten form, on a molten zinc cathode and chlorine gas is evolved from the cathode. Thus, molten zinc chloride may be continuously fed to the electrolytic cell, and molten zinc metal and chlorine gas continuously removed from the cell.

The LiCl-KCl electrolyte permits the use of a wide range of zinc chloride concentrations in the bath. Thus, the zinc chloride concentration in the bath may vary from about 0.6 to 40 mole-percent without fuming or freezup of the bath. This is not possible with any other bath composition that can be economically used for electrowinning zinc metal; for instance, the potassium chloride-zinc chloride bath freezes at 500° C when the zinc chloride concentration drops to 27 mole-percent, and the sodium chloride-zinc chloride bath freezes at 500° C when the zinc chloride concentration drops to 31 mole-percent. This wide range of permissible zinc chloride concentrations is of particular advantage in the process of the invention since efficiency of the process, in terms of current efficiency and energy requirements, is generally at a maximum when zinc chloride concentrations are in the range of about 1 to 20 mole percent. In addition, fuming is not a problem at these optimum zinc chloride concentrations.

The required purity of the zinc chloride feed will depend on the desired purity of the metallic zinc product. Generally, a high purity zinc chloride is required to obtain a high-purity zinc product.

The temperature of the bath should be kept as close to the freezing point of zinc metal as practical in order to prevent undue volatilization of zinc metal and zinc chloride. Suitable temperatures will range from about 450° to 550° C, with a temperature of about 500° C generally being preferred. The electrolysis is conducted by means of direct current at a cathode current density of about 2 to 10 amp/in$^2$. Current density is, however, not critical and the optimum value may vary considerably with the specific composition of the bath, temperature, cell configuration, etc. Cell potential is also not critical but should be kept as low as possible to decrease energy requirements. Generally, $ZnCl_2$ concentrations of about 1 to 20 mole percent keep the cell potential at a minimum.

The process of the invention may be carried out in any conventional electrolytic cell capable of use with a molten salt electrolyte, and adapted to provide a cathode of molten zinc metal, e.g., in the example below the process is carried out in a Pyrex beaker. Another suitable cell material is graphite, which offers the advantage of direct electrical contact with the cathodic zinc pool. The desired operating temperature may be maintained by any conventional means, such as heating in an electric resistance furnace. Passage of the electrolytic current may, in some cases, be sufficient to maintain the operating temperature.

The following example will serve to more specifically illustrate practice of the invention.

EXAMPLE

This example illustrates preparation of zinc metal by electrolysis of a molten $ZnCl_2$-LiCl-KCl bath on a small batch scale. The electrolysis was conducted in a 3.5-inch ID × 7-inch deep Pyrex beaker containing 360 grams of molten zinc metal in the bottom thereof, beneath the molten $ZnCl_2$-LiCl-KCl bath. The molten zinc served as the cathode and electrical contact thereto was made by means of a graphite rod 0.25 inch in diameter and 12 inches long inserted into the beaker and immersed in the molten zinc. This rod was enclosed in a 6 mm ID glass tube in the region of the molten bath in order to shield the rod electrically from the bath.

The molten bath consisted of 1300 grams of the following composition: 20 mole percent (38 weight percent) $ZnCl_2$, 47.2 mole percent (27.9 weight percent) LiCl and 32.8 mole percent (34.1 weight percent) KCl. The anode consisted of a 0.75-inch diameter × 12-inch long graphite rod immersed in the molten bath and positioned about 1 inch above the surface of the molten zinc cathode and about 1.38 inches from the side wall of the beaker.

Electrolysis was then conducted for 2 hours at a bath temperature of 500°C and a cathode current density of 5 amp/in$^2$, a cell potential of 3.2 volts and a cell current of 10 amperes. This resulted in deposition of 23.7 grams of molten zinc, in excess of that added initially, to the cathode. Current efficiency was 97 percent and the energy consumed by the electrolysis was 1.2 kw-hr/lb of zinc.

We claim:

1. A method for recovery of metallic zinc from zinc chloride comprising electrolyzing a molten bath consisting essentially of zinc chloride and an electrolyte consisting of about 50 to 70 mole percent of lithium chloride and about 50 to 30 mole percent of potassium chloride.

2. The method of claim 1 in which the electrolyte consists of about 59 mole percent lithium chloride and 41 mole percent potassium chloride.

3. The method of claim 1 in which the molten bath consists of about 0.6 to 47 mole percent zinc chloride.

4. The method of claim 3 in which the molten bath consists of about 1 to 20 mole percent zinc chloride.

5. The method of claim 1 in which the cathode employed in electrolysis consists of molten zinc.

6. The method of claim 1 in which the temperature of the electrolysis is about 450° to 550° C.

7. The method of claim 6 in which the temperature of the electrolysis is about 500° C.

* * * * *